United States Patent [19]

Dahan

[11] Patent Number: 4,678,446

[45] Date of Patent: Jul. 7, 1987

[54] DEVICE FOR RESCUING PERSONNEL FROM WATERS

[75] Inventor: Paul C. Dahan, Pittstown, N.J.

[73] Assignee: Mobil Oil Corporation, New York, N.Y.

[21] Appl. No.: 794,329

[22] Filed: Nov. 4, 1985

Related U.S. Application Data

[63] Continuation of Ser. No. 489,637, Apr. 28, 1983, abandoned.

[51] Int. Cl.[4] ..... B63C 9/00

[52] U.S. Cl. ..... 441/80

[58] Field of Search ..... 441/83, 86, 87, 80; 114/365, 366, 368, 369, 370, 371, 372, 373, 374; 212/190, 191, 192, 193, 194; 33/397

[56] References Cited

U.S. PATENT DOCUMENTS

| | | | |
|---|---|---|---|
| 776,125 | 11/1904 | Dutton | 212/190 |
| 1,016,500 | 2/1912 | Hinz | 33/397 |
| 1,804,945 | 5/1931 | Miller | 212/190 |
| 1,902,972 | 3/1933 | Rouse | 114/268 |
| 2,557,079 | 6/1951 | Cutri | 441/80 |
| 3,228,044 | 1/1966 | Matterson | 9/14 |
| 3,421,165 | 1/1969 | Pugh | 441/83 |
| 4,138,077 | 2/1979 | Okumura | 441/83 |
| 4,139,110 | 2/1979 | Roberts | 114/372 |
| 4,271,553 | 6/1981 | Korsvik | 114/373 |
| 4,280,430 | 7/1981 | Wilson et al. | 114/51 |

FOREIGN PATENT DOCUMENTS

| | | | |
|---|---|---|---|
| 1374766 | 12/1964 | France | 114/368 |
| 2012238A | 7/1979 | United Kingdom . | |
| 192040 | 3/1967 | U.S.S.R. | 441/80 |
| 624825 | 8/1978 | U.S.S.R. | 441/83 |
| 660888 | 5/1979 | U.S.S.R. | 114/365 |
| 679482 | 8/1979 | U.S.S.R. | 114/365 |

*Primary Examiner*—Joseph F. Peters, Jr.
*Assistant Examiner*—Stephen P. Avila
*Attorney, Agent, or Firm*—Alexander J. McKillop; Michael G. Gilman; Malcolm D. Keen

[57] ABSTRACT

A device for rescuing personnel from water comprising a crane positioned on a boat or other rescue structure and including a horizontally and vertically movable crane boom. An elongated member is vertically movable with respect to the crane boom, and a float is positioned beneath the elongated member for floating on the water. A net extends below the float, and means are provided for supporting the net from the elongated member.

1 Claim, 12 Drawing Figures

DEVICE FOR RESCUING PERSONNEL FROM WATERS

This is a continuation of copending application Ser. No. 489,637, filed on Apr. 28, 1983 now abandoned.

BACKGROUND OF THE INVENTION

1. Field of the Invention

The present invention relates to a device for rescuing personnel from waters. More particularly, the invention relates to rescuing personnel from frigid and hostile seas without the need for participation of the individuals being rescued.

2. Description of the Prior Art

When personnel either voluntarily or involuntarily fall into hostile and frigid waters, particularly at offshore facilities, the cold waters cause hypothermia to set in very quickly. Typically, such hypothermia occurs in 8 to 15 minutes without survival suits and in about 45 minutes to slightly over one hour with survival suits. Thus, survival depends upon removing such personnel from the sea as quickly as possible.

Existing equipment such as lifelines, rafts and life preservers are often ineffective in heavy weather and confused seas because the violent motion of the rescue boat prevents the victim from being removed from the sea without the possibility of the individual severely banging against the hull of the boat. Further, with such equipment, the victim must provide some assistance in his rescue.

SUMMARY OF THE INVENTION

In accordance with the present invention, there is provided a device for rescuing personnel from water comprising a crane positioned on a rescue structure such as an offshore platform or a boat and including a horizontally and vertically movable boom. An elongated member is vertically movable with respect to the boom, and buoyant means is operatively connected to the elongated member for floating on the water. A net extends beneath the buoyant means, and means are provided for supporting the net beneath the buoyant means.

When personnel are in the water, the crane is operated to move the boom from an inboard position to an outboard position, and the elongated member is permitted to move downwardly with respect to the boom such that the buoyant means floats on the water. At this position, the net extends beneath the float in the water. The net is moved forwardly by operation of the boom (and/or boat) such that the individual(s) are within the net. The operator then manipulates the boom to hoist the individual(s) out of the water and deposit the individual(s) on the rescue structure.

Thus, the present invention provides for scooping personnel out of the water without such personnel needing to assist in their own rescue. Such rescue can occur quickly and safely to thus increase the chance of the rescued personnel to survive.

DESCRIPTION OF SPECIFIC EMBODIMENTS

Figure 1:
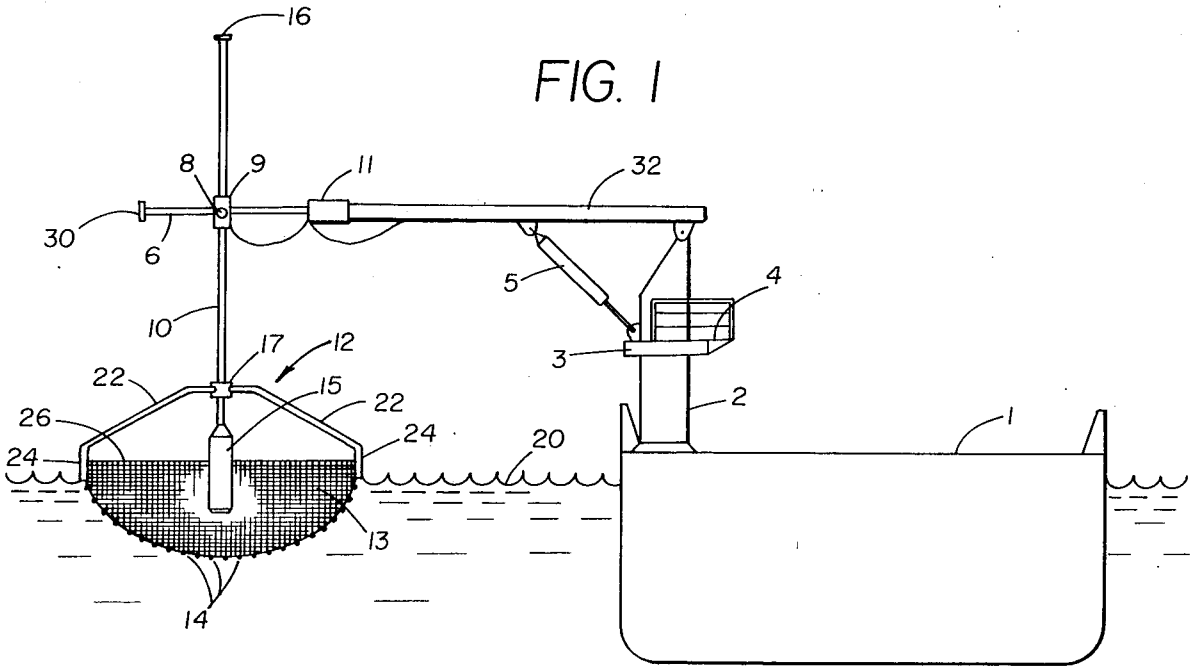
FIG. 1 is a rear elevational view of a crane operated rescue device according to the present invention mounted on a work or rescue boat.
Figure 2:
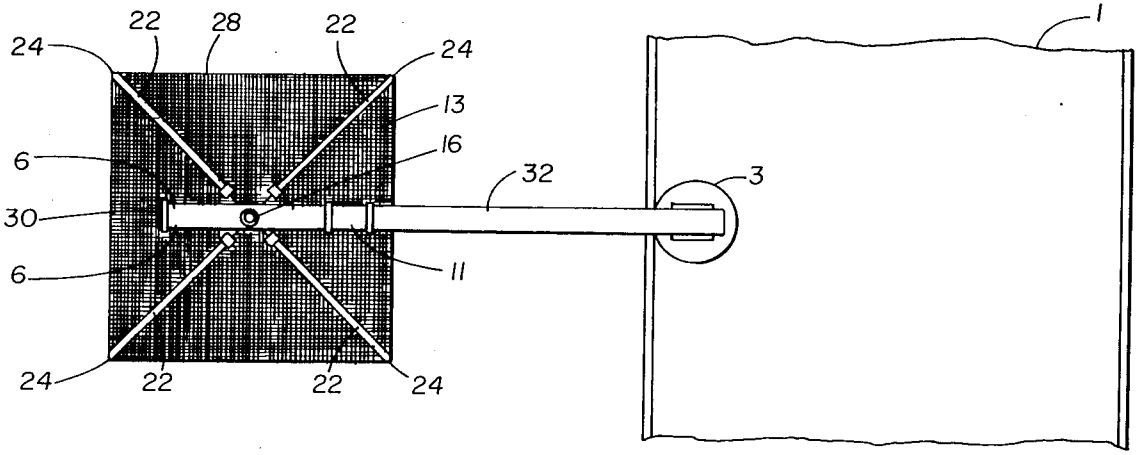
FIG. 2 is a top plan view of the rescue device and a portion of the boat shown in FIG. 1.

With reference to FIGS. 1 and 2 there is shown a rescue device having a buoyant means or a float 15 which is freely floatable on the surface of the water 20. Attached to the float 15 is a high tensile strength elongated member or pipe 10 which is slidable in a guide 9. A frame 12 has four arms 22 extending outwardly from a frame support bracket 17, and the bracket 17 is connected to the pipe 10.

A rescue net 13 is attached to the outer ends 24 of arms 22 of the rescue net frame 12. The net 13 has a plurality of weights 14 secured thereto to maintain the curved shape shown in FIG. 1 below the water line 20. The net 13 extends upwardly at the rear end and sides thereof to a level 26 above the water line 20. Such level 26 is defined by the net-to-arm connections 24. The front end 28 of the net 13 is opened such that the front end 28 extends downwardly below the water line 20 as shown in FIG. 1.

Figure 9:
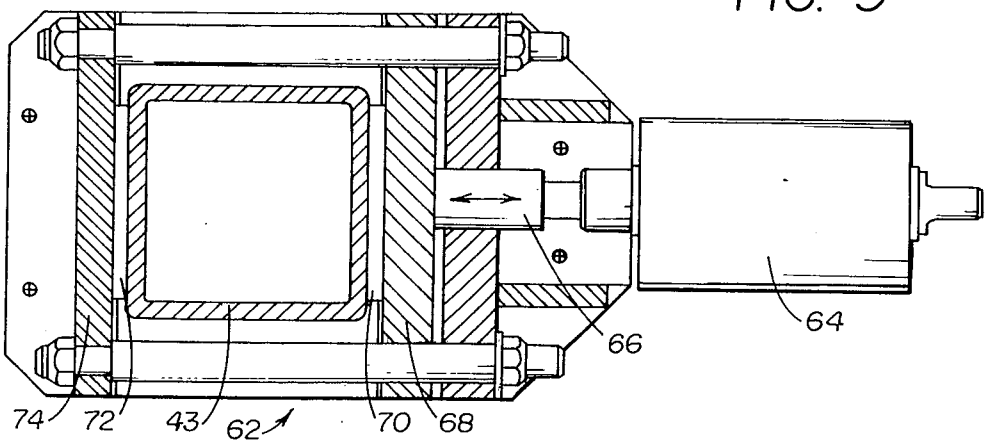
FIG. 9 is a cross-sectional view of the brake taken along line 9—9 of FIG. 8.
Figure 8:
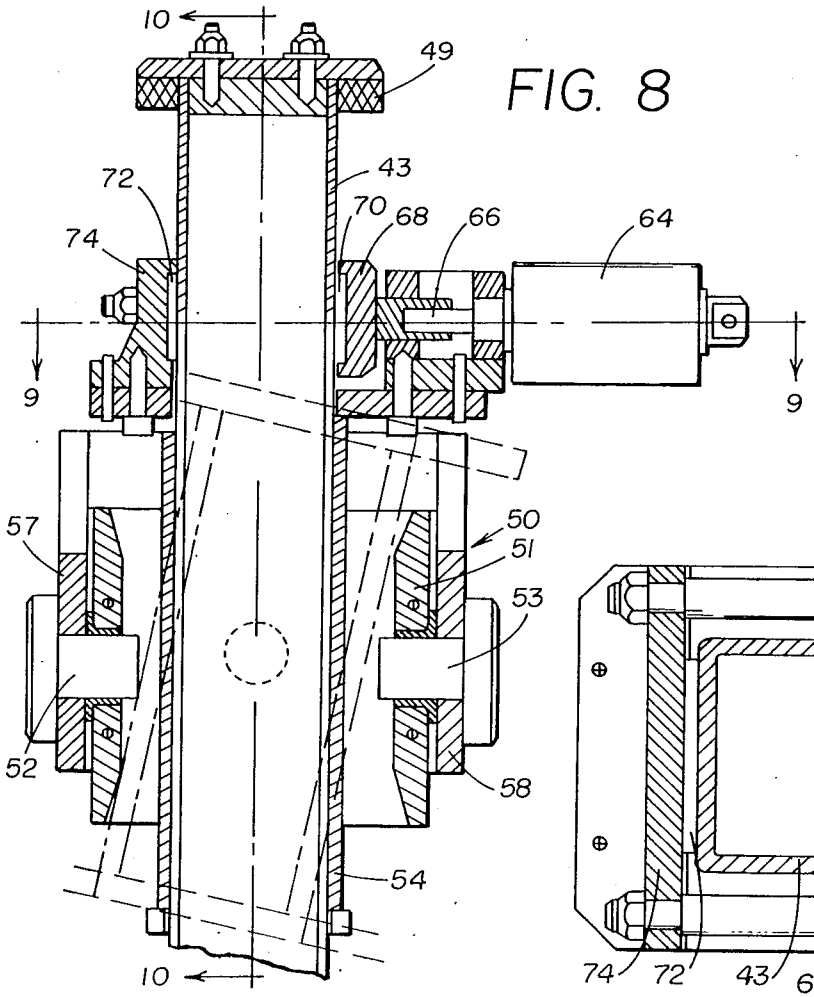
FIG. 8 is a cross-sectional view of a gimbal and brake assembly for the embodiment shown in FIG. 4.

The pipe 10 has a safety stop 16 at the upper end thereof having an outer dimension larger than the guide 9 such that the pipe 10 will stop sliding downwardly when the safety stop 16 abuts the top end of the guide 9. The guide 9 is attached to a gimbal frame 8 which permits the pipe 10 incline freely in any direction. The pipe 10 is vertically movable through the gimbal 8. Since the pipe 10 is freely movable in any direction and vertically, means are provided for compensating for the motion of the boat 1 with respect to the water line 20 whereby the float 15 and the net 13 follow the contour of the water line 20. As will be described hereinafter, the embodiment of FIGS. 1 and 2 contemplate the use of a brake system such as shown in FIGS. 8 and 9 for locking the pipe 10 with respect to the guide 9.

Figure 12:
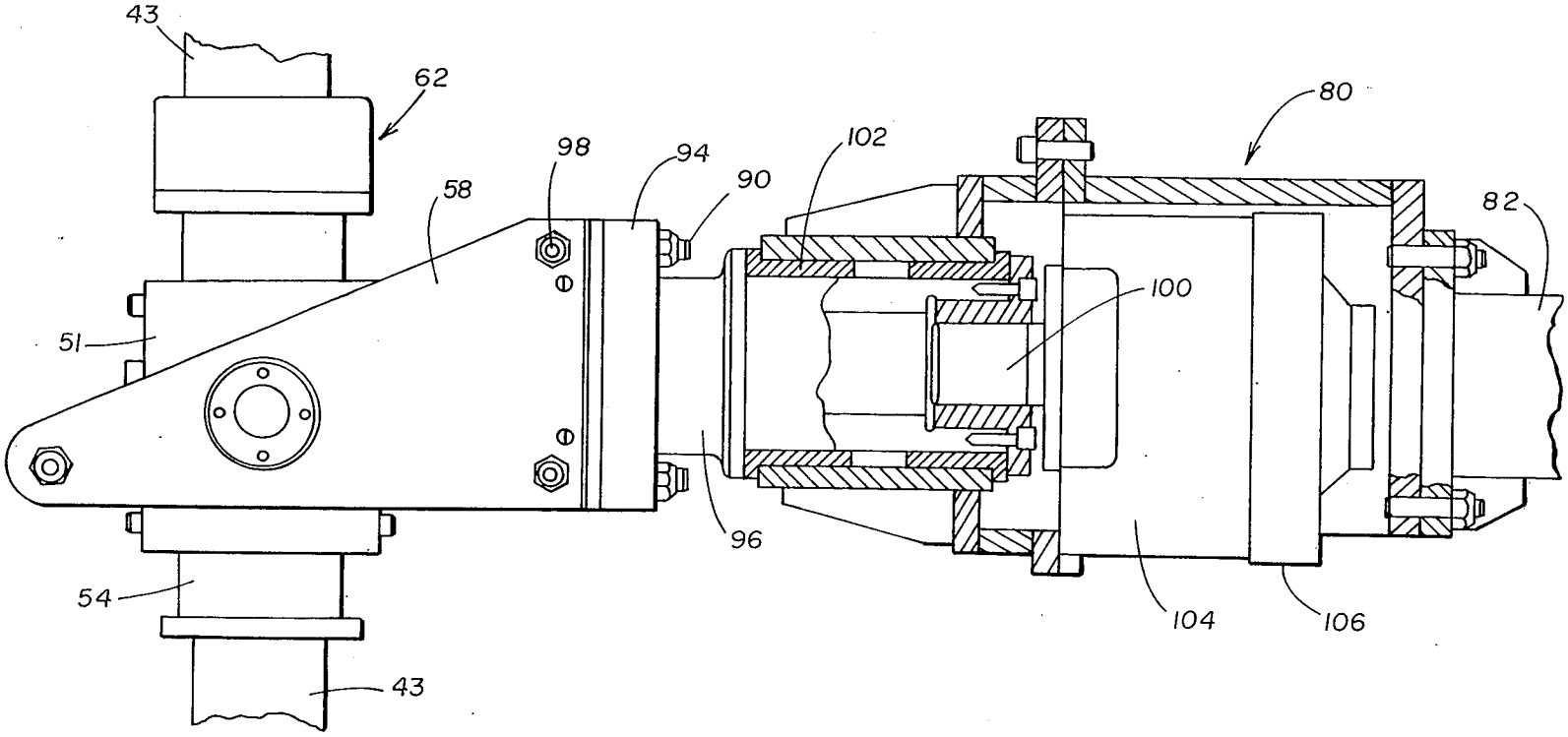
FIG. 12 is a vertical cross-section of a swing head for rotating the boom of the embodiment shown in FIG. 4.

The gimbal 8 is also slidable freely along guide rails 6. A safety stop 30 is provided at the outer end of the guide rails 6 for abutting contact with the gimbal 8. The gimbal 8 is lockable relative to the guide rails 6 by means of hydraulic locking pins (not shown), actuated through hydraulic line 33. The guide rails 6 are connected to rotary actuator system 11 such as will be described hereinafter with reference to FIG. 12. The swing head 11 is mounted on the boom 32 of a hydraulic crane 2. The crane 2 has an operating platform 4 mounted on a rotatable table 3. A hydraulic ram 5 is connected to the boom 32 for moving the arm 32 upwardly or downwardly. The crane 2 mounted on the work or rescue boat 1 can be any standard or specially adapted crane capable of lowering and raising the entire rescue device quickly into and out of the water.

Figure 6:
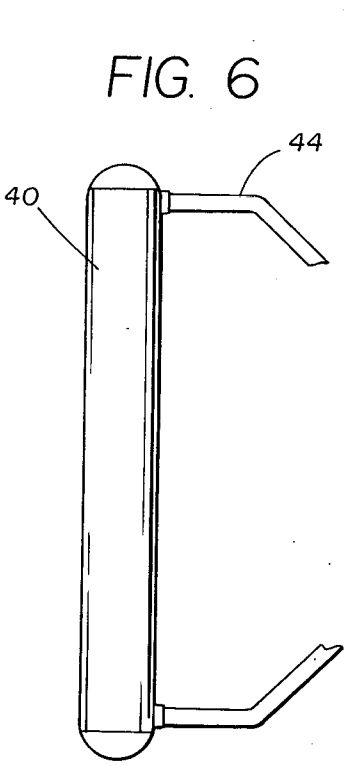
FIG. 6 is a side elevational view of a float used in the embodiment of FIG. 4.
Figure 5:
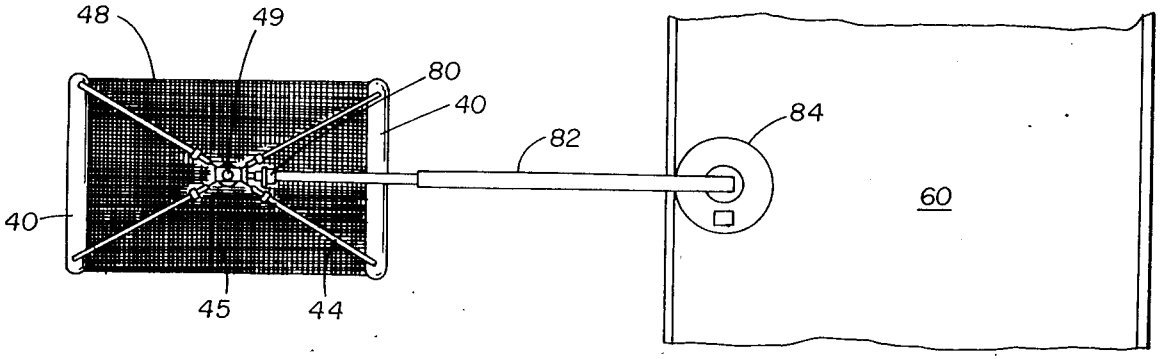
FIG. 5 is a top plan view of the rescue device and a portion of the boat shown in FIG. 4.
Figure 7:
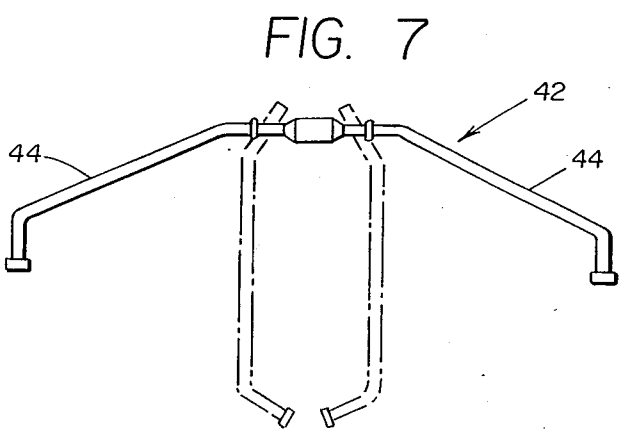
FIG. 7 is an end elevational view of the float supporting arms shown in opened and closed positions for the embodiment shown in FIG. 4.
Figure 4:
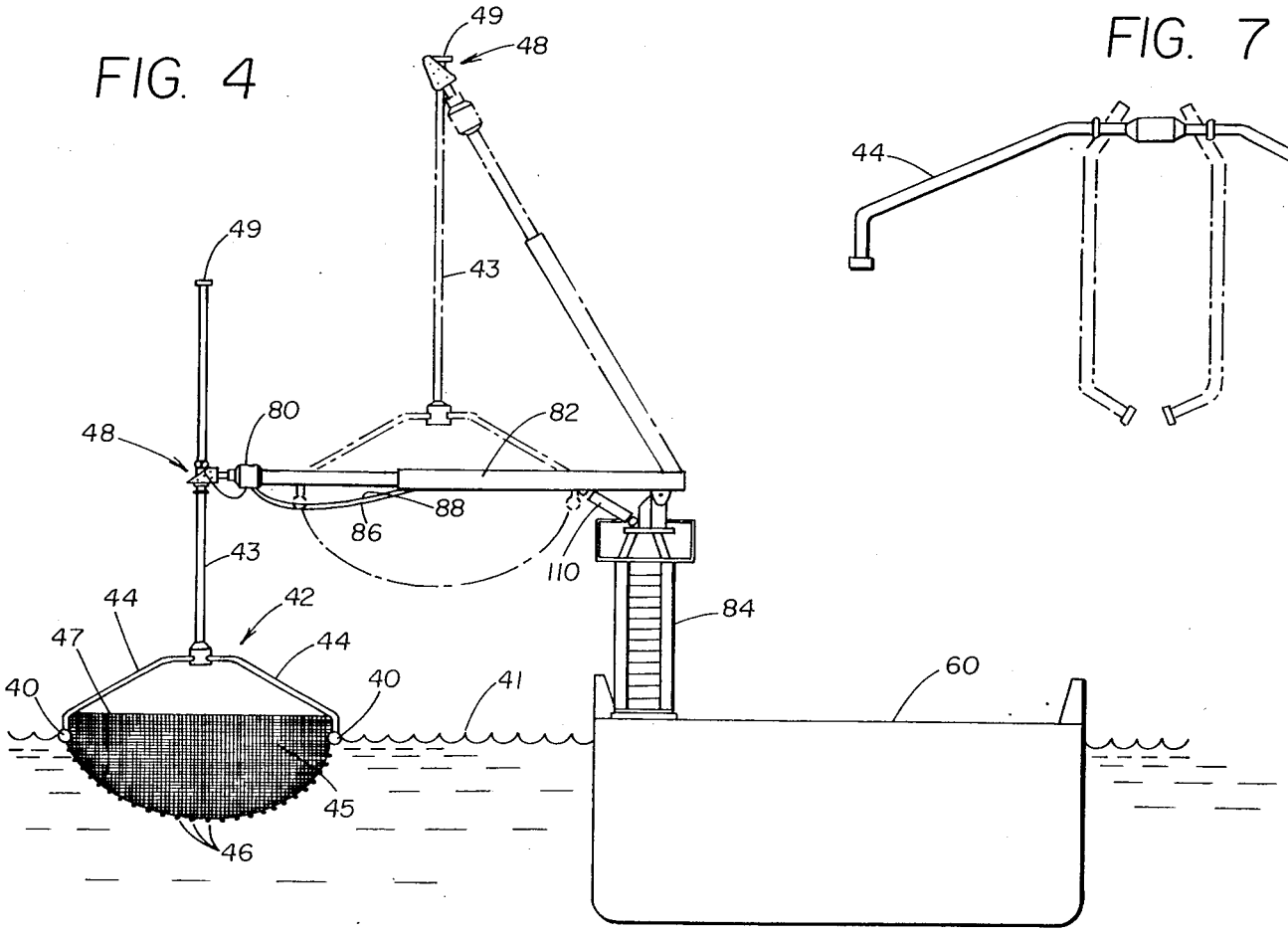
FIG. 4 is a rear elevational view of another embodiment of a crane operated rescue device according to the present invention mounted on a work or rescue boat.

With reference to FIGS. 4 and 5, there is shown another embodiment of the rescue device in accordance with the present invention wherein buoyant means are in the form of spaced elongated floats 40 which function as pontoons freely floatable on the surface of the water 41. A frame 42 interconnects a high tensile strength elongated member or pipe 43 by means of four arms 44 extending outwardly to the ends of the floats 40. FIG. 6 shows a side elevational view of one Of the floats 40. FIG. 7 shows the frame 42 in an expanded and closed position.

A rescue net 45 is attached to the outer ends of arms 44 of the frame 42. The net 45 has a plurality of weights 46 secured thereto to maintain the curved shape shown in FIG. 4 below the water line 41. The net 45 extends upwardly at the rear end and sides thereof to a level 47 above the water line 41. The front end 48 of the net 45 is opened such that the front end 48 extends downwardly below the water line 41 to provide a generally semicircular front end opening.

The pipe 43 extends upwardly through a gimbal and brake mechanism 48, and has a safety stop 49 at the upper end thereof having an outer dimension larger than the opening through the gimbal and brake mechanism 48. Thus, the pipe 43 will stop sliding downwardly when the safety stop 49 abuts the top of the gimbal brake and mechanism 48 as shown in dashed lines in FIG. 4.

Figure 10:
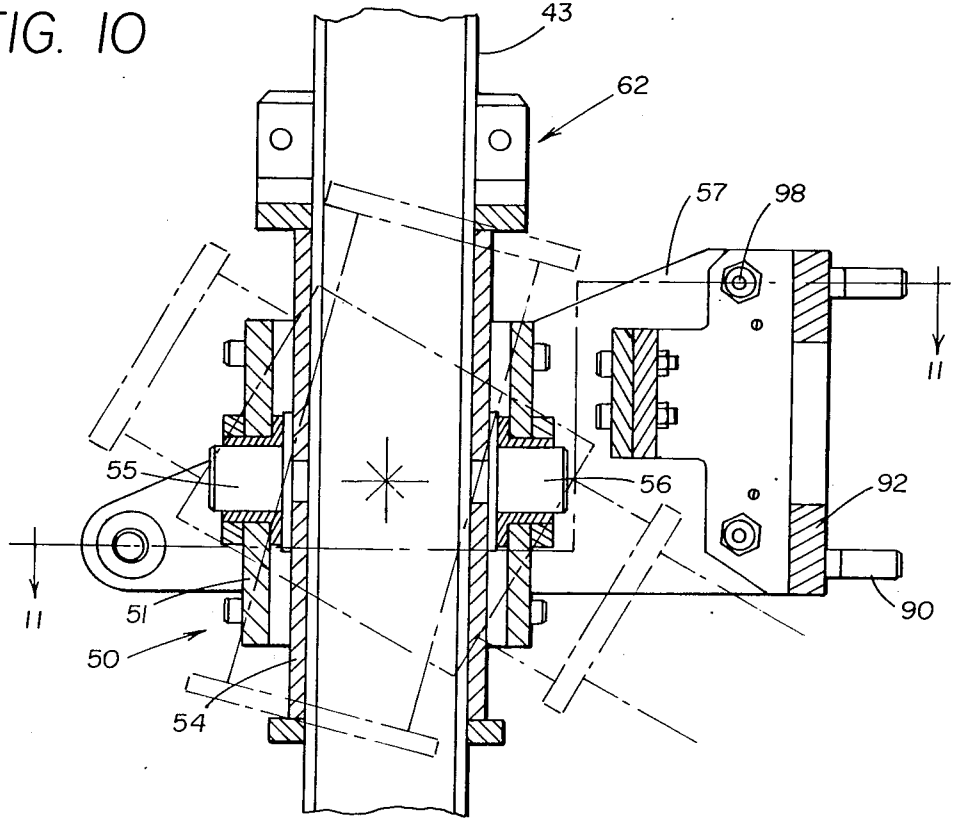
FIG. 10 is a cross-sectional view of the gimbal taken along line 10—10 of FIG. 8.
Figure 11:
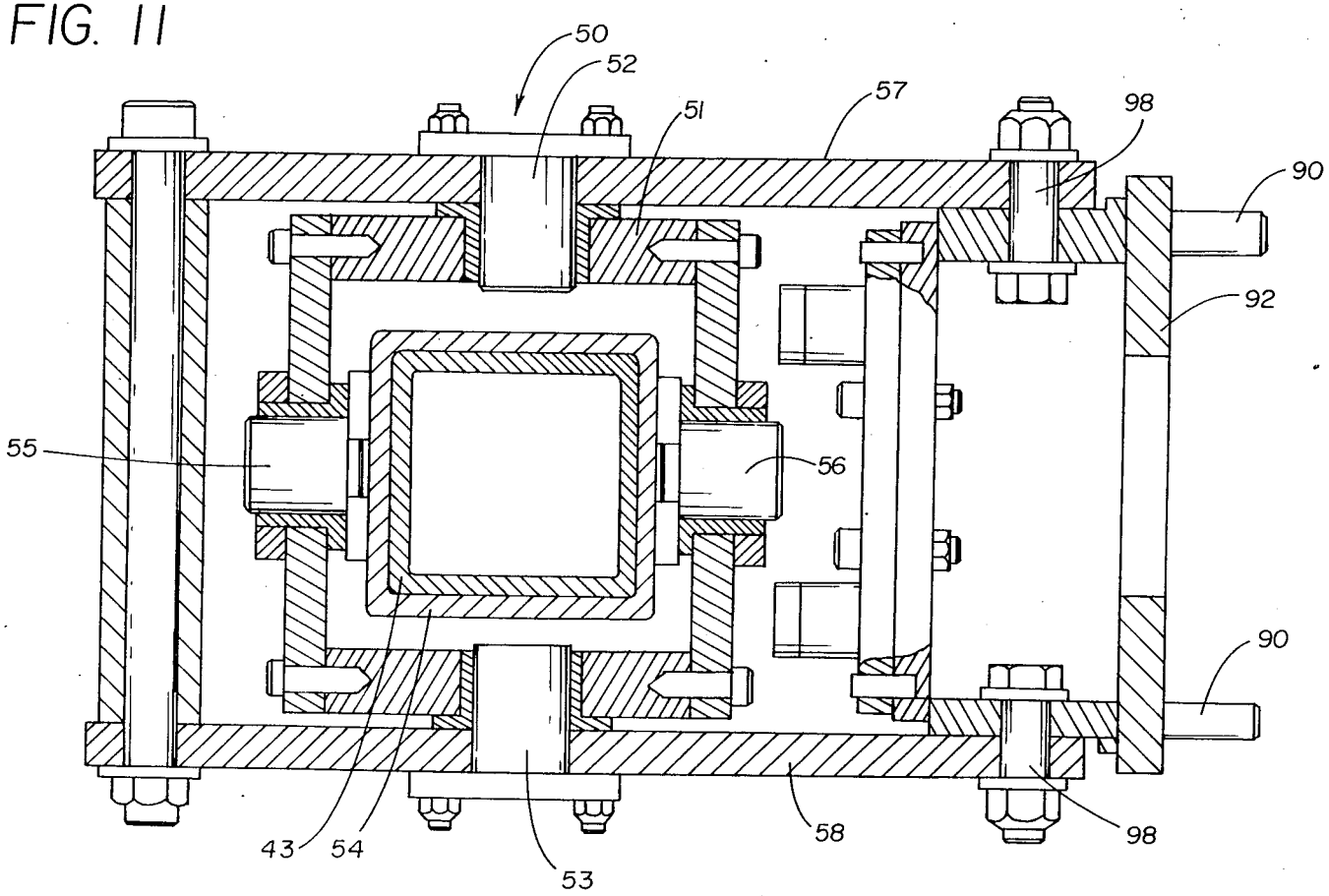
FIG. 11 is a cross-sectional view of the gimbal taken along line 11—11 of FIG. 10.

A suitable 9imbal system 50 is shown in FIGS. 8, 10 and 11. With reference to FIG. 11, the gimbal system 50 has an outer elongated rectangular frame 51 pivotable about an axis defined by opposing posts 52, 53 and an inner elongated rectangular frame 54 pivotable about an axis defined by posts 55, 56. The outer rectangular frame 51 is mounted to spaced gimbal support arms 57, 58. The pipe 43 has a rectangular cross-section and is freely vertically movable through the inner rectangular frame 54 of the gimbal system 50. As represented by the dashed lines for the inner rectangular frame 54 in FIGS. 8 and 10 showing the inner rectangular frame 54 in various inclined positions, the gimbal system 50 permits the pipe 43 to incline freely in any direction. The combination of the pipe 43 being freely vertically movable and being freely inclinable in any direction provides compensation for the relative motion of the boat 60 with respect to the water line 41 and thereby permits the floats 40 43 and net 45 to follow the contour of the water line 41.

The gimbal and brake mechanism 48 includes a brake system 62 mounted above the gimbal system 50. With reference to FIG. 9, the brake system 62 has a hydraulic cylinder 64 which actuates a piston 66 in the directions shown by the arrow heads to move a plate 68 and an attached brake pad 70. When the piston 66 is moved to the left as viewed in FIG. 9, the pipe 43 is secured between the brake pad 70 and an opposing brake pad 72 mounted on a fixed plate 74. When the piston 66 is moved to the right as viewed in FIG. 9, brake pad 70 is moved away from the pipe 43 permitting the pipe 43 to freely move through the brake system 62. A suitable cylinder is the Flairline Hydraulic Cylinder, Series H 4" Bore×1" Stroke, 500 psi pressure, 6,000 lbs. total load.

The gimbal and brake mechanism 48 is connected by means of a rotary actuator system 80 to a boom 82 of a crane 84 mounted on the boat 60. A hydraulic hose 86 for the brake system 62 extends along the boom 82. Another hydraulic hose 88 for the rotary actuator system 80 also extends down the boom 82.

The gimbal system 50 is mounted by bringing plate 92 into contact with a plate 94 and securing bolts 90 through the plate 94. A shaft 96 extends through the plates 92, 94 and is secured by nut and bolt arrangements 98 to the spaced gimbal support arms 57, 58. The shaft 96 is connected at its other end to a spline 100, and is rotatable within a bearing 102 by operation of a rotary actuator 104 which is connected to the spline 100. The rotary actuator 104 is responsive to hydraulic pressure via hose 88 through inlets 106. The rotary actuator system 80 thus provides for applying a rotary motion to the pipe 43 and net 45 about an axis as defined by the longitudinal axis of the boom 82. A suitable actuator is the ROTAC Rotary Actuator, Model 26R-62, Double Vane 100° rotation.

Figure 3:
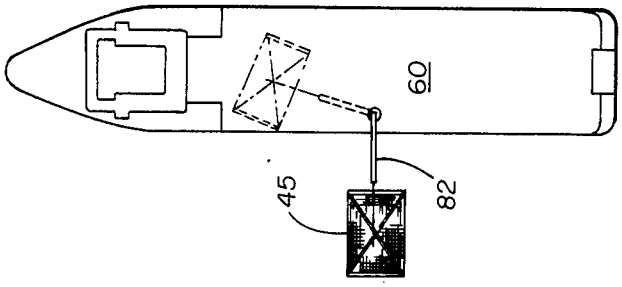
FIG. 3 is a top plan view of a rescue device in accordance with the present invention and boat showing the rescue device in outboard and inboard positions.

To use the rescue device, an operator would operate the hydraulic crane 84 to move the net 40 from its inboard position as shown in dashed lines in FIG. 3 to an outboard position as shown in solid lines in FIG. 3. When moving the net to its outboard position, the pipe 43 is locked with respect to boom 82 by means of the hydraulically powered brake system 62. The brake system 62 is then released to permit the pipe 43 to slide downwardly through the gimbal system 50 until floats 40 reach their buoyant position. The boat 60 approaches along side the individual(s) at a suitable reduced speed and at a suitable distance which may be in the order of approximately ten meters from the side of the boat 60 to the center of the net 45. The net 45 is moved forward by operation of the crane and/or boat such that the individual(s) are positioned within the net 45 through its open front end 48. The operator may also use the rotary actuator system 80 to scoop the net 45 under the individual(s). The operator then locks the brake system 62 to fix the pipe 43 with respect to its boom 82. By actuating a hydraulic ram 110, the individual(s) are quickly hoisted out of the water, and the crane 84 is rotated to the position shown in dashed lines in FIG. 3 to quickly deposit the individual(s) on the deck of the boat 60.

What is claimed is:

1. A device for rescuing personnel from water comprising:

a crane on a boat, said crane including a horizontally and vertically movable boom;

an elongated rigid member vertically and freely movable with respect to said boom;

means connected to said boom for permitting inward and outward movement of said elongated member along the axis as defined by said crane arm;

buoyant means operatively connected to said elongated member for floating on the water;

a net extending below said buoyant means;

said buoyant means also defining the vertical relative position of said elongated member with respect to said boom while positioning individual(s) in said net; and means for selectively locking said elongated member relative to said boom when said net is moved to or from said boat and for unblocking said elongated member relative to said boom when said buoyant means and net are placed in water, said permitting means comprising a pair of rails and a gimbal mechanism slidable on said rails, said gimbal mechanism being operatively connected to said elongated member for compensating for motion of said boat and the water surface, whereby said buoyant means and said net follow contour of the water surface.

* * * * *